United States Patent [19]

Schumacher et al.

[11] Patent Number: 4,596,945

[45] Date of Patent: Jun. 24, 1986

[54] MODULATOR SWITCH WITH LOW VOLTAGE CONTROL

[75] Inventors: Robert W. Schumacher, Canoga Park; Robin J. Harvey, Thousand Oaks, both of Calif.

[73] Assignee: Hughes Aircraft Company, Los Angeles, Calif.

[21] Appl. No.: 610,215

[22] Filed: May 14, 1984

[51] Int. Cl.[4] ..... H01J 11/04

[52] U.S. Cl. ..... 315/344; 250/426; 313/161; 313/359.1; 315/111.41; 315/338

[58] Field of Search ..... 250/426, 427; 315/111.41, 344, 338; 313/161, 162, 366, 359.1

[56] References Cited

U.S. PATENT DOCUMENTS

| | | | |
|---|---|---|---|
| 4,034,261 | 7/1977 | Lutz | 315/344 |
| 4,247,804 | 1/1981 | Harvey | 315/344 |
| 4,322,661 | 3/1982 | Harvey | 315/344 |
| 4,362,972 | 12/1982 | Donaldson | 315/344 |

*Primary Examiner*—Harold Dixon

*Attorney, Agent, or Firm*—G. D. Ogrod; J. A. Sarjeant; V. D. Duraiswamy

[57] ABSTRACT

A cold-cathode, plasma discharge modulator switch is disclosed. A crossed-field discharge plasma supplied charge carriers for the switch. A dc magnetic field is employed to provide a highly localized cusp magnetic field near the cathode, so that gas ionization occurs primarily in the cathode-source grid gap. The region between the cathode and anode is filled with a relatively low pressure gas. A highly transparent control grid with small apertures is closely spaced from the anode. The switch is closed through application of positive potential (relative to the plasma) to the control grid, and opened through application of negative potential relative to the plasma to the control grid. The application of negative potential to the control grid creates an ion sheath around the control grid which permits plasma cut-off to the anode region provided the sheath size is larger than the control grid aperture radius. Upon plasma cut-off, the switch current is interrupted as the remaining plasma in the control grid-anode gap decays. Low pressure operation insures that ionization cannot sustain the plasma in the narrow, isolated control grid-anode gap.

45 Claims, 32 Drawing Figures

Fig. 1.
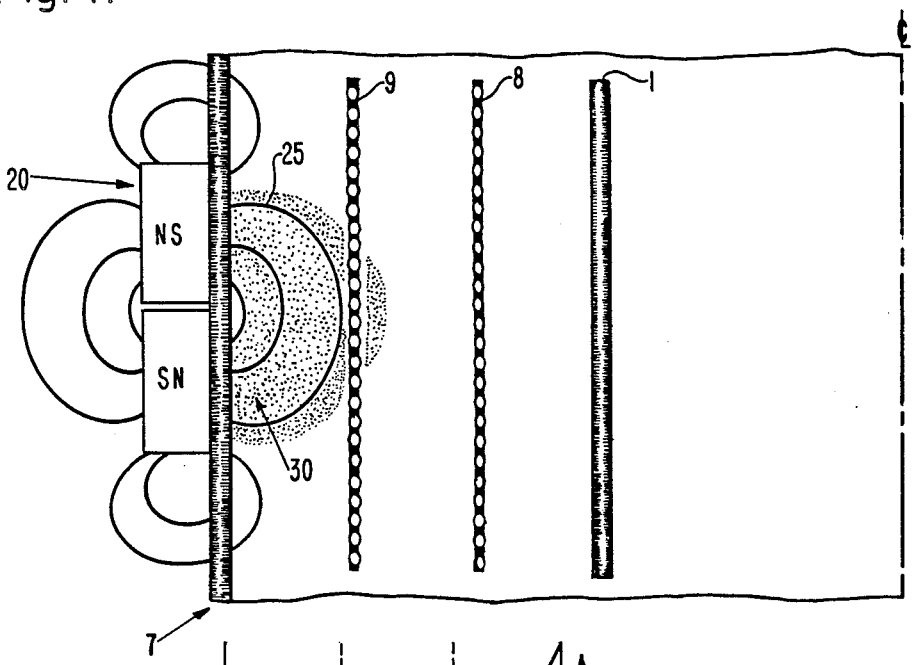
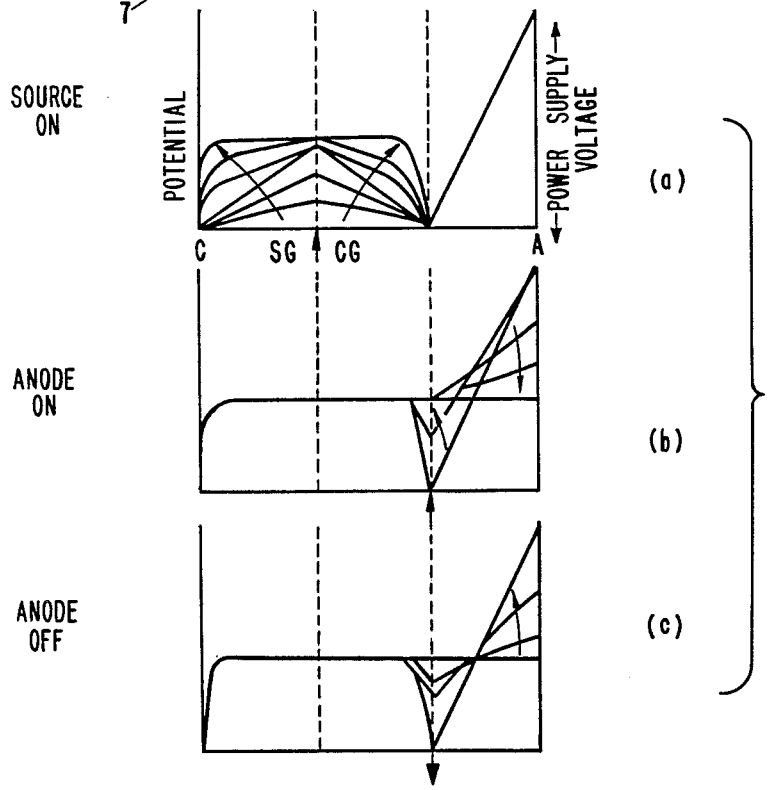
Fig. 3.

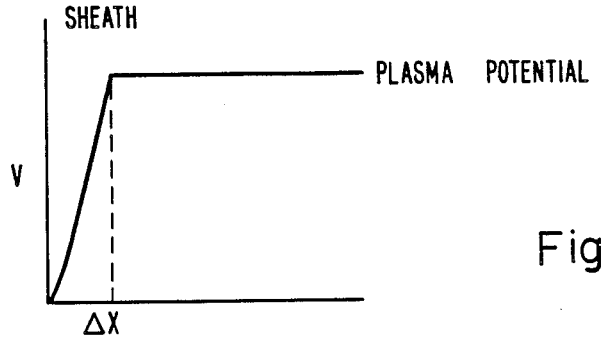
Fig. 5.
Fig. 7.
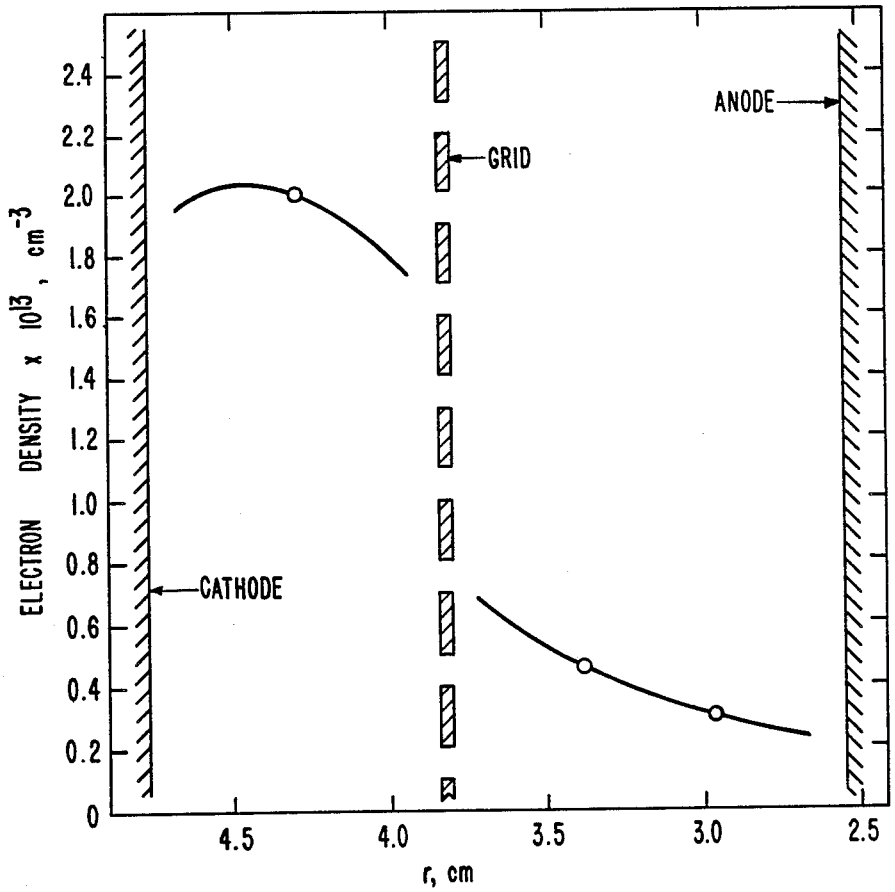

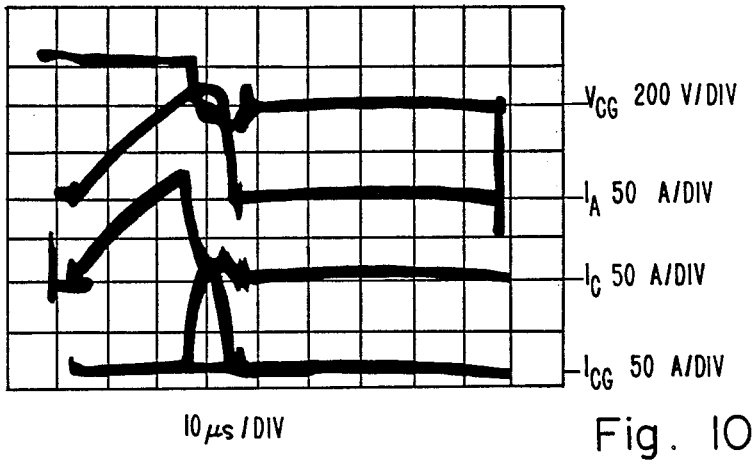
Fig. 10.
Fig. 11a.
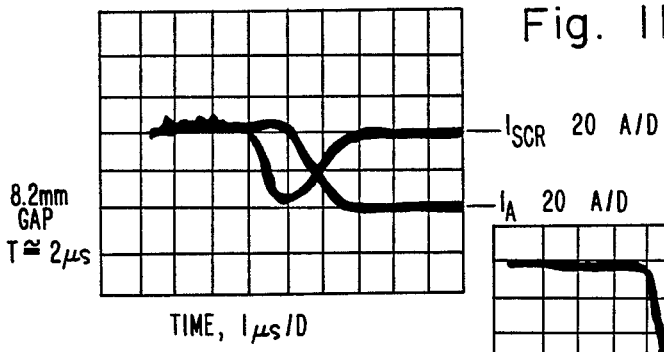
Fig. 11b.
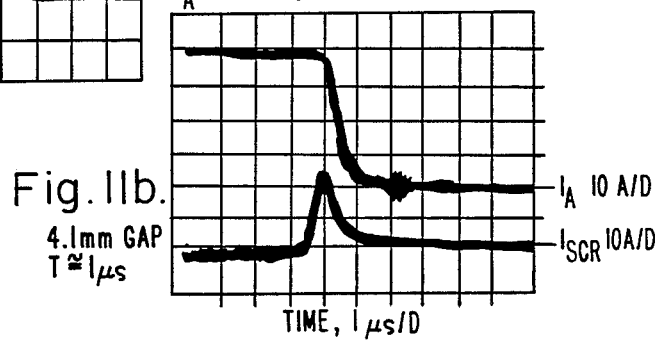
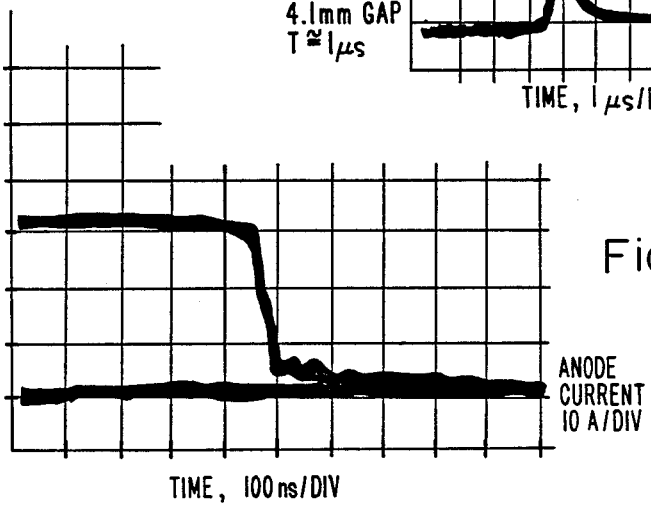
Fig. 12

Fig. 23.
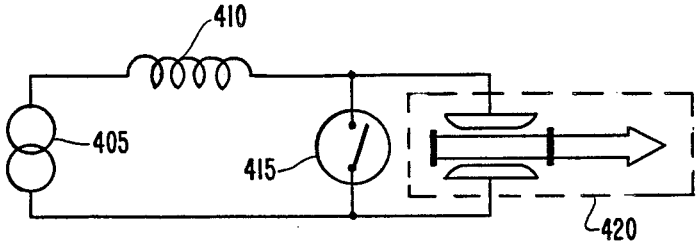
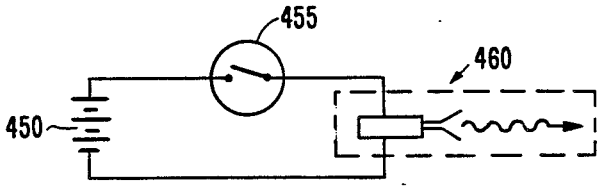
Fig. 24.

MODULATOR SWITCH WITH LOW VOLTAGE CONTROL

BACKGROUND OF THE INVENTION

The present invention is related to the field of cold cathode, crossed-field discharge switches for high current, high voltage applications.

The present invention is an improvement to the cold cathode, grid-controlled, crossed-field switch which is described in U.S. Pat. No. 4,247,084, "Cold Cathode Discharge Device with Grid Control," assigned to the assignee of the present application. This issued patent is incorporated into this application by this reference.

Generally, the device described in the above-referenced patent comprises a cold cathode, grid-controlled, crossed-field switch which can be repetitively operated in the presence of a fixed magnetic field.

While U.S. Pat. No. 4,247,084 is directed to rapid closing and current control features of the switch, it does not explicitly describe modulator operation or current interruption capability through convenient control grid potential manipulation as may accomplished with hard-vacuum thermionic cathode switches (hard tubes). The patent does indicate (in the abstract and column 4, lines 30–32) that the anode current may be controlled linearly with the control grid. However, it further states (Column 4, lines 36–40) that once the control grid is immersed in the plasma, that grid control may be lost, and that the switch may recover to its nonconducting state (interrupting) by stopping the supply of current to the anode and control grid rather than by simply driving the control grid to negative potentials.

U.S. Pat. No. 4,247,804 references several background patents for cross-field switches: U.S. Pat. Nos. 3,638,061; 3,641,384; 3,604,977; 3,558,960; 3,678,289; 3,769,537; 3,749,978 and 4,034,260.

Another type of switch device commonly employed in medium and high power switch applications is the thyratron. In general the thyratron comprises an anode, a control grid and a thermionic cathode, in an envelope filled with a gas at a relatively high pressure. The tube remains in a non-conducting state with a positive voltage on the anode, provided a potential equal to (or more negative than) the cathode potential is applied to the control grid. During conduction, a sheath of ions around the grid prevents voltage applied to the grid from penetrating to the main discharge body; as a result, grid control is lost. The thyratron may be returned to its non-conducting state only when the anode current is commutated to zero for a recovery time sufficient to allow the charge density to decay sufficiently to allow grid control to be achieved.

A thyratron, then, is a switch which is turned on by positive grid voltage but which may be turned off only by commutation of the anode current. Thyratron operation is described, for example, in the reference "Hydrogen Thyratrons," issued by the GEC Electron Tube Company Limited Company, United Kingdom, 1972.

A modified thyratron device, known as the tacitron, is described in "The Tacitron, A Low Noise Thyratron Capable of Current Interruption by Grid Action," E. O. Johnson, J. Olmstead and W. M. Webster, Proceeding of the I.R.E., September, 1954. The tacitron device described in the reference is understood to be directed to a tube design adapted for operation in a discharge mode wherein ion generation occurs solely in the control-grid-to-anode region. This discharge mode is is said to allow positive ion sheaths from a negative grid to span the grid holes and choke off tube current. The mode is achieved by selection of the overall tube geometry and characteristics, including the size of the grid openings, the gas and its pressure. The tacitron device described in this paper, however, is believed to be adapted to interrupt only relatively small anode currents.

Reference has appeared in literature published in the USSR to tacitron devices said to be adapted to high-power applications. Two such papers are "Powerful Tacitrons and Some of Their Characteristics in a Nanosecond Range," V. D. Dvornikov, S. T. Latushkin, V. A. Krestov, L. M. Tikhomirov, and L. P. Yudin, Pribory i Tekhnika Eksperimenta, July and August 1972, No. 4, 108–110, and "High-Power Tacitron-Based Pulsed Generator," A. S. Aref'ev, V. F. Gnido, and B. D. Maloletkov, Pribory i Tekhnika Eksperimenta, Vol. 2, pp. 117–118, January-February, 1981.

Both the thyratron and tacitron are hot cathode devices which require a continuous high power source to keep the cathode hot. Both devices have an anode and have a control grid. The tacitron employs small grid apertures and relatively low gas pressure (e.g., 0.05 to 0.3 Torr) to provide a current interrupting capability.

It is, therefore, an object of the present invention to provide a cold cathode switch system adapted for modulator operation and switch opening capabilities.

It is another object of the present invention to provide a switch which can be repetitively opened and closed in high current, high voltage applications.

A further object of the present invention is to provide a switch for high voltage, high current applications which can be modulated on and off by a low voltage control.

Still another object of the invention is to provide a cold cathode, crossed-field discharge switch system adapted for control by control grid potential manipulation.

SUMMARY OF THE INVENTION

The present invention is a crossed-magnetic field discharge switch system comprising a cold cathode, a source grid, a high transparency control grid with small apertures and an anode which are disposed in a spaced relation. The control grid is located as close to the anode as allowed by vacuum breakdown considerations. A low pressure gas fills the gaps between the cathode, grids and anode. Charges for conduction are generated by a plasma discharge near the cathode, produced by a crossed-field cold-cathode discharge technique in the gap between the cathode and the source grid. The gap is magnetized with a cusp field supplied by permanent magnets attached to the outside of the switch. A voltage means is coupled to the control grid and is adapted to pulse the control grid above the plasma potential to close the switch and allow conduction of charges to the anode. The anode voltage then falls to a 200-Volt forward-drop level and plasma fills the switch volume. To open the switch and interrupt the anode current, the voltage means returns the control grid to cathode potential or below.

With the ionization source highly localized near the cathode, and the control grid positioned near the anode, the ion density in the vicinity of the control grid is low relative to the anode. The low ion flux allows current interruption by applying negative potentials (relative to the plasma) to a control grid having small yet finite-sized apertures. Through application of negative potentials, an ion sheath is created around the control grid which permits plasma cut-off to the anode region, provided the sheath size is larger than the grid aperture radius. Upon plasma cut-off, switch current is interrupted as the remaining plasma in the control grid-anode gap decays. Low pressure operation insures that ionization cannot sustain the plasma in the control grid-anode gap.

The switch may be operated, with appropriate control grid circuitry, as a modulator switch or an inductive-energy-system (IES) switch, for high voltage, high current applications.

Other features and improvements are disclosed.

BRIEF DESCRIPTION OF THE DRAWINGS

These and other features, objects and advantages of the invention will be more fully apparent from the detailed description set forth below taken in conjunction with the drawings in which like reference characters identify corresponding parts throughout and wherein:

FIG. 1 is a simplified longitudinal cross section of a switch in accordance with the present invention, depicting the relationship of the structure elements.

FIGS. 3(*a*)–(*c*) are graphs illustrating the relative potential across the device between the cathode and anode for the respective conditions "source on," "anode on" and "anode off."

FIG. 5 is a graph illustrating the Child-Langmuir sheath theory.

FIG. 7 plots the radial plasma density distribution in the switch with only one grid.

FIG. 10 depicts the control grid voltage, anode current, cathode current and control grid current as a function of time, illustrating the variation of these parameters as electrostatic interruption of anode current occurs.

FIGS. 11(*a*) and (*b*) depict the anode and control grid SCR current waveforms during interruption for two control grid-anode gap spacings.

FIG. 12 depicts the anode current waveform, illustrating ultra-fast interruption.

FIG. 23 is a simplified block diagram illustrating the switch employed in a circuit wherein the switched load is a gas discharge laser.

FIG. 24 is a simplified block diagram illustrating the switch employed in a circuit wherein the switched load is a resistive load.

DETAILED DESCRIPTION OF THE PREFERRED EMBODIMENTS

Figure 2:
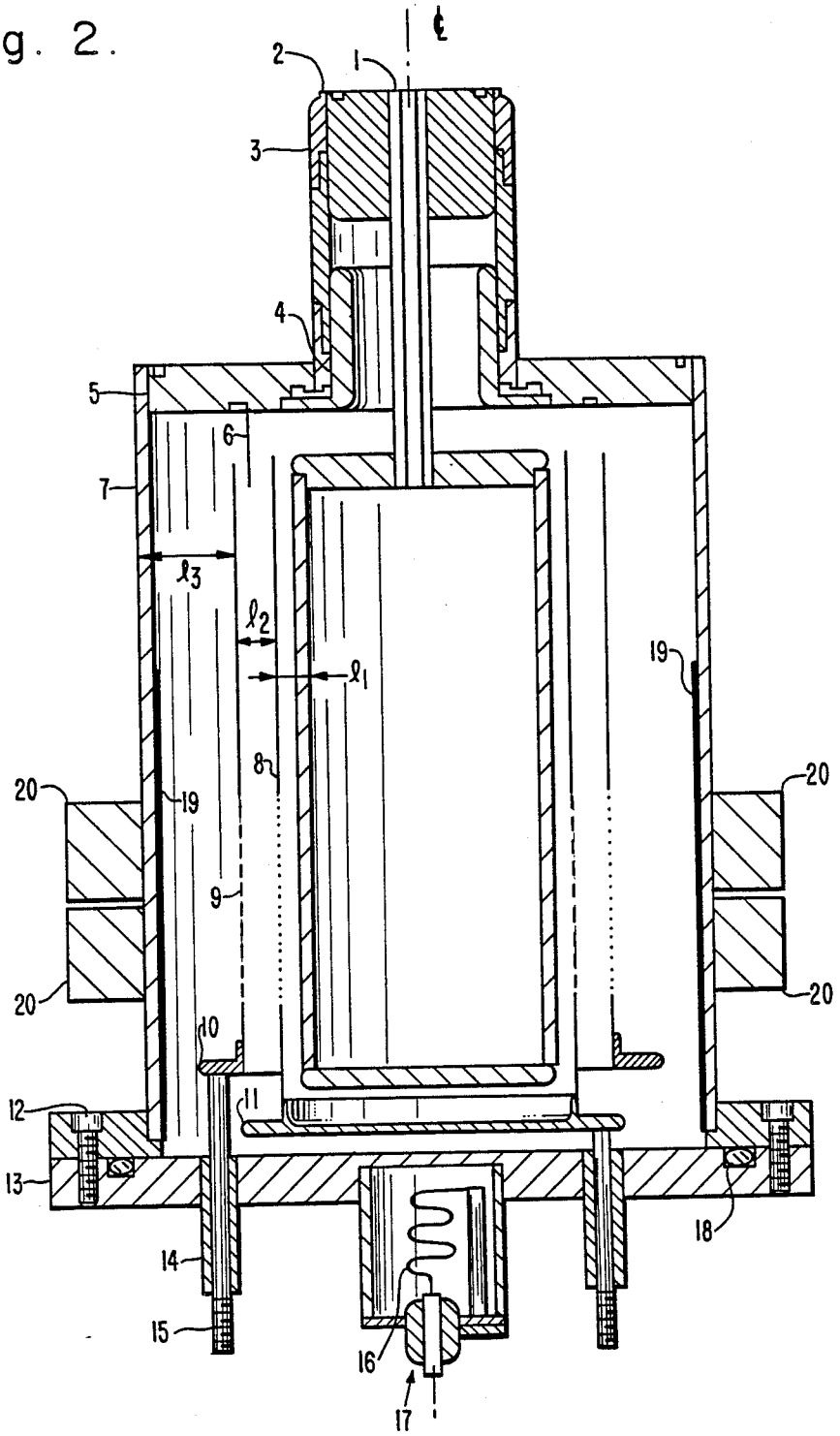
FIG. 2 is a longitudinal cross section of a presently preferred embodiment.

The present invention comprises a novel modulator switch with low voltage control. The following description of the preferred embodiment of the invention is provided to enable any person skilled in the art to make and use the present invention. Various modifications to this embodiment will be readily apparent to those skilled in the art, and the generic principles defined herein may be supplied to other embodiments. Thus, the present invention is not intended to be limited to the embodiment shown, but is to be accorded the widest scope consistent with the principles and novel features disclosed herein.

I. INTRODUCTION

The modulator switch of the present invention is based upon a crossed-magnetic-field discharge in a four-element, coaxial system comprising of a cold cathode, two grids, and an anode, as illustrated in FIG. 1, which elements are more particularly described in U.S. Pat. No. 4,247,804.

In a manner analogous to thyratron operation, charges for conduction are generated by a plasma discharge near the cathode 7. However, in the switch of the present invention, the plasma 30 is produced by a crossed-field cold-cathode-discharge technique (or other cold-cathode discharge technique) in a gap located between the source grid 9 (which serves as the anode for the local crossed-field discharge) and the cathode 7. The gap is magnetized with a cusp field indicated by field lines 25, supplied by permanent magnets 20 attached to the outside of the switch. This arrangement eliminates the need for (but does not preclude the use of) cathode heater power and also permits instant-start operation. Other embodiments for producing the plasma 30 may incorporate hollow cathode discharges, diffused arc discharges, or hollow cathode, diffused arc, or crossed-field discharges in combination with heated cathode discharges. These plasma sources are adaptable to producing a plasma density at the control grid surface which is uniform and of the same relative density as for the crossed-field discharge of the preferred embodiment, while providing a high plasma density at the cathode surface (as will be described below).

The switch is closed by pulsing the second, control-grid electrode 8 above the plasma potential to allow conduction of charges to the anode. The anode voltage then falls to the 200-V forward-drop level and plasma fills the switch volume between the anode and the cathode.

At this point, grid control of a conventional plasma device is usually no longer possible. In a thyratron, for example, if current interruption is attempted by returning the control grid to cathode potential or below, plasma will continue to flow through the grid to maintain conduction. However, in the present switch system, current interruption through control-grid potential manipulation can be maintained for cathode current densities up to 7 A/cm$^2$. This novel feature of the switch is enabled in the preferred embodiment by four elements:

1. Grid Structure: High transparency grids (80%) with small apertures (0.32 mm dia.) which are preferably produced by chemical etch techniques.

2. Control Grid Position: The control grid is located as closed to the anode as allowed by vacuum breakdown considerations.

3. Localized Ionization Source: Using a highly localized cusp magnetic field near the cathode, ionization occurs primarily in the cathode-to-source grid gap.

4. Low Pressure: Low gas pressure (e.g., Helium, hydrogen, cesium or mercury at 1–50 milliTorr), enabled by the use of crossed-field discharge, is used.

With the ionization source highly localized near the cathode and the control grid positioned near the anode, the ion density in the vicinity of the control grid is low (relative to the cathode). The low ion flux allows current interruption by applying negative potentials (relative to the plasma) to a grid having small, yet finite size (0.3-to-1-mm diameter) apertures. As will be discussed in more detail below, through application of negative potentials, an ion sheath is created around the grid which permits plasma cut-off to the anode region provided the sheath size is larger than the grid aperture radius. Upon plasma cut-off, switch current is interrupted as the remaining plasma in the control-grid-to-anode gap decays. Low pressure operation insures that ionization cannot sustain the plasma in the narrow, isolated control-grid-to-anode gap.

The current control features of the switch are achieved as a result of the following conditions. To provide a switch adapted to carry high current densities at low voltage requires a plasma. To control the current electrostatically, the plasma density must be low at the control electrode. The current flow at the anode is primarily electron current, which is compatible with a low plasma density, due to the high mobility of the electrons. The current at the cathode in the presence of a plasma is dominated by ions which have a low mobility; thus at the cathode, the plasma density must be relatively high to maintain a high current density. The source of plasma must, therefore, provide a high plasma density at the cathode, but which is substantially reduced at the control electrode. It is also advantageous to provide a plasma density which is uniform over the active surface of the cathode and over the active surface of the control electrode. Embodiments which are able to achieve these conditions are adapted to control current in a plasma discharge.

Referring now to FIG. 2, the physical structure of the preferred embodiment of the switch is illustrated in cross-sectional view. The switch is of radial construction. Anode assembly 1, preferably fabricated of stainless steel, is disposed at the center axis of the switch. Anode adapter 2 and ceramic anode insulator 3, with shield 4 and anode mount flange 5, fix the anode assembly in relation to the other switch elements.

The cathode tube assembly 7, which may be fabricated from stainless steel, defines the outer periphery of the switch. Control grid 8 and source grid 9, which also may be fabricated from stainless steel, are held in spaced relation from the anode and cathode 7 by respective mounting rings 11,10. Plasma baffle 6 is disposed between the source and control grids. Cathode flange 12, grid support flange 13, grid mount high voltage bushings 14 and grid mount studs 15 comprise support structure to support the cathode 7 and control grid 8 and source grid 9.

Element 16 comprises a gas reservoir and may be constructed of titanium. A ceramic vacuum feedthrough 27 is also provided. Seal 18 is provided to seal the mating surfaces of flanges 12 and 13.

A cathode liner 19 is provided on the interior surface of the cathode tube assembly 7. Molybdenum is the preferred material for the cathode liner, having been found to provide reproducible, reliable switch operation. The liner has a thickness of 0.005 inches in the preferred embodiment.

Permanent magnets 20 are disposed around the outer periphery of the cathode. The magnets are adapted to provide a strong cusp field on the order of 500–1000 Gauss near the cathode liner 19, but negligibly low in gaps $l_1$ and $l_2$. This condition is satisfied if the radius of curvature of the field is less than the dimension $l_3$.

The cathode of the preferred embodiment has a 15 cm diameter. The control grid-anode gap width $l_1$ is 5 mm, the source grid-control grid $l_2$ is 1.0 cm and the cathode-source grid gap width $l_3$ is 2.54 cm.

Electrical connections (not shown in FIG. 2) are also provided to connect the anode, cathode, source grid and control grid to the external and switch system circuitry.

High voltage current-interruption experiments have been performed at a current density level of 7 A/cm$^2$ which corresponds to a total switch current of 250 A using a 9.5-cm-diameter prototype switch. Operation has been demonstrated as both a modulator switch with a resistive load and as an opening switch for IES systems, with open-circuit voltage up to 20 kV, conduction voltage of only 250 V, and opening times of 2 $\mu$s. The power required to initiate interruption in these experiments is relatively nominal; a simple TTL level signal from a high impedance pulser is sufficient. At lower current levels, on the order 30 A, ultra-fast interruption times of about 50 ns have also been demonstrated with low jitter (5ns). In operation as a closing switch, the switch has closed from 30 kV to conduct 300 A with a 20-ns risetime at 16 kHz PRF. As a consequence of the fast recovery time (1 $\mu$s at current density 5 A/cm$^2$), the present device is also capable of dual-pulse-modulator service with a short, variable dwell time between pulses. This feature has been used to produce two 2-$\mu$s-wide pulses at 15 kV and 45 A, with variable dwell times as short as 2 $\mu$s and with 200-ns rise and fall times.

These switch capabilities allow development of efficient and programmable high-power pulse-modulator systems using a simple capacitor bank or power supply and an air-cooled series switch operated with low-voltage control circuits. Table 1 summarizes the performance of the switch realized to date.

TABLE I

Demonstrated Performance Parameters For Modulator Switches

| Switch Parameter | Demonstrated Performance |
|---|---|
| Open Circuit Voltage | 30 kv |
| Conduction Voltage | 200–500 V |
| Current | 400 A |
| Closing Time | 20 ns |
| Opening Time | 50 ns |
| Pulse Repetition Frequency | 16 kHz |

Other embodiments of the cold-cathode, plasma-generating section of the switch are possible if they are subject to the basic requirements for the control of high current densities stated above—that the plasma be of high density near the cathode to carry the high ion-current density required by a cold cathode, and of low plasma density near the control grid to provide control of the current. In general, this means that the plasma is formed near the cathode, and it can be made to decay or be attenuated in the direction of the control grid by, for example, diffusion through a distance, diffusion through a magnetic field, the attenuation action of a source grid or the introduction of the auxiliary grids for the purpose of attenuating the plasma density. Examples of the more general embodiments include: hollow-cathode discharges (e.g., as a plasma source in a closing switch, Bespalov et al, Pribory i Technika Eksperimenta No. 1, pp. 149–151, January–February 1982, Plenum Press translation, p. 169); wire-anode discharges (e.g., Wakalopulos, Ion Plasma Electron Gun, U.S. Pat. No. 3,970,872; Bayless et al, Continuous Ionization Injector for a Low Pressure Gas Discharge, U.S. Pat. No. 3,949,260); diffuse-discharge-arc sources (such as found in ignitrons, liquid-metal-plasma valves, orientation-independent ignitrons, and certain vacuum interrupters). Since the secondary emission yield of the cathode may be enhanced by heating the cathode, or since contact ionization (such as with cesium vapor) may be enhanced by elevated temperatures, heated cathodes may be used to advantage in some applications when used in combination with the cold-cathode, plasma-generating embodiments.

II. CURRENT INTERRUPTION THROUGH ELECTROSTATIC GRID CONTROL

Operation of the switch through electostatic control of grids is shown schematically in FIG. 3. As discussed above, charges for conduction are provided by a low-pressure gas discharge in the source section of the switch, the area between the source grid and the cathode. The source plasma is generated (see FIG. 3(*a*)) by pulsing the potential of the source grid (SG) electrode to +1 kV for a few microseconds to establish a crossed-field discharge. When equilibrium is reached, the SG becomes voltage regulated at 200 V above the cathode (C) potential. With the control grid (CG) remaining at cathode potential, the switch remains open and the full anode (A) voltage appears across the CG-to-A gap.

The switch can now be closed (the anode switched ON) by releasing the CG potential, or by pulsing it momentarily above the 200-V plasma potential. As plasma streams through the CG, electrons are neutralized by the space charge of the ions collected by the anode and the switch conducts at a rate higher than the space-charge-limited electron current. Thus, the anode voltage falls to the 200-V level, as shown in FIG. 3(*b*).

In order to open the device (or switch the anode OFF, FIG. 3(*c*)), the CG is returned to cathode potential or below in hard tube fashion.

However, this last operation is not usually successful in plasma switches. Depending upon the size of the grid apertures, the potential of the grid relative to the plasma, and the local ion density, plasma may continue to stream through the CG to the anode region to maintain conduction. Also, even if plasma is cut-off by the grid, conduction may persist if the gas pressure is high enough to sustain ionization in the CG-to-A gap. Thus, as will be described below, successful current interruption in a plasma switch depends upon low gas pressure and upon the physics of the grid-plasma interaction.

Figure 4:
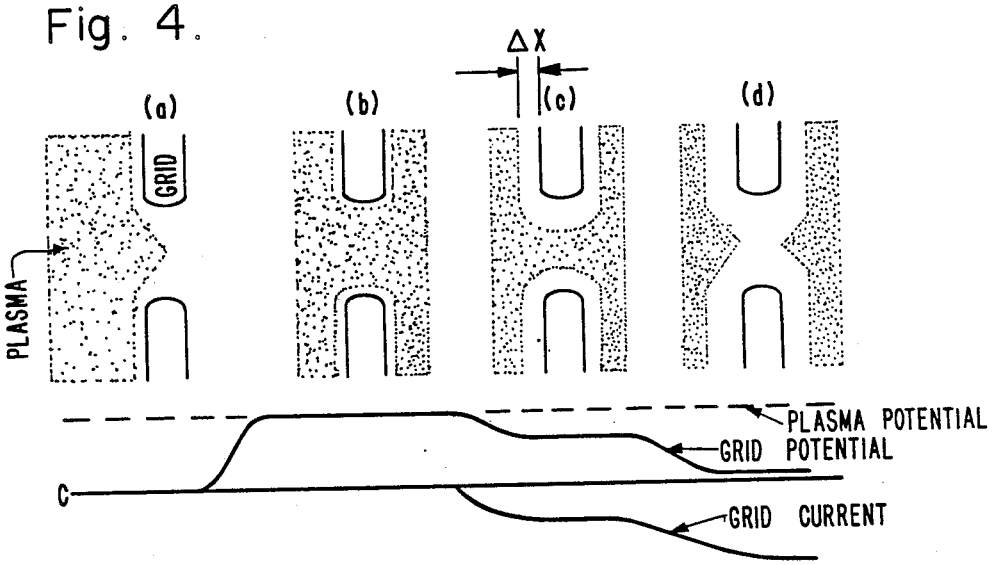
FIGS. 4(*a*)–(*d*) illustrate the grid-plasma interaction and grid-control process of the present invention.

It is noted that when the CG voltage is raised to the plasma potential, plasma from the source section diffuses through the grid (FIG. 4(*a*)) to occupy the CG-to-A gap (FIG. 4(*b*)). If the grid voltage is now driven below the plasma potential (FIG. 4(*c*)), the grid will begin to draw ion current and an ion-space-charge-limited sheath will appear between the plasma and the grid. The amount of ion current drawn depends upon the plasma density and temperature; and the size of the sheath ($\Delta x$) is determined by the ion current density (J) and the voltage difference (V) between the CG and plasma.

The functional relationship between J, $\Delta x$, and V is given by the Child-Langmuir sheath theory which is summarized in FIG. 5 and Equation 1.

$$J = \left(\frac{4}{9}\epsilon_o\sqrt{\frac{2e}{m}}\right)\frac{V^{1.5}}{\Delta x^2} = K\frac{V^{1.5}}{\Delta x^2} \quad (1)$$

where $K = 2.73 \times 10^{-8}$ (Helium ions).

If as shown in FIG. 4(*d*), the ion current is sufficiently low and the voltage is sufficiently high that the sheath dimension expands beyond the radius of the grid aperture, then plasma cut-off is achieved and ions can no longer diffuse to the right of the grid into the anode region. As the now-isolated plasma in the CG-to-A gap begins to dissipate (e.g., by erosion), charges for conduction are lost and the anode current is interrupted, provided the gas pressure is low enough that ionization is not sustained in the gap.

In thyratrons and other high-pressure devices (ignitrons and spark gaps), this condition is not satisfied and plasma cut-off is not achieved due to high plasma densities and very small sheaths. Consequently, current interruption by grid control is not possible. However, in the preferred embodiment of the switch, low-pressure operation (approximately 10–50 mTorr) is made possible by the crossed-field discharge. Electron trapping in the cusp magnetic field leads to rapid, but localized, high-density plasma production near the cathode of the C-to-SG gap at low pressure.

Figure 6:
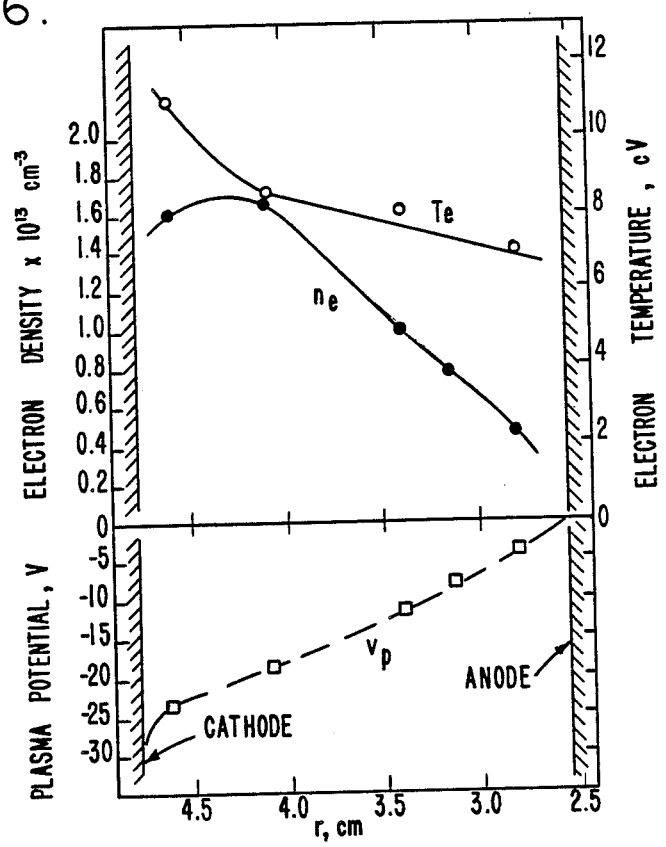
FIG. 6 plots the radial distribution of the plasma density, electron temperature and plasma potential in the switch with its source and control grids removed.

Furthermore, as a consequence of the localization of plasma near the cathode by the cusp field, the plasma density falls sharply toward the anode and leads to large sheaths near the CG. This expected non-uniform, radial-plasma-density distribution has been measured with Langmuir probes in the switch with the grids removed and is plotted in FIG. 6. FIG. 6 plots the radial distribution, from cathode to anode, of the plasma density, $n_e$, electron temperature, $T_e$, and plasma potential, $V_p$, in the switch with both grids removed. The plasma density at the location of the CG near the anode is nearly four times lower than the density at the cathode. When the source grid is installed, the plasma density near the anode is even lower as a result of plasma loss to the SG surface. FIG. 7 is a graph plotting the plasma density distribution in the switch with the source grid installed, but with the control grid removed. FIG. 7 shows that with the source grid installed, the density near the anode is reduced by a factor of eight compared to that near the cathode.

Figure 8:
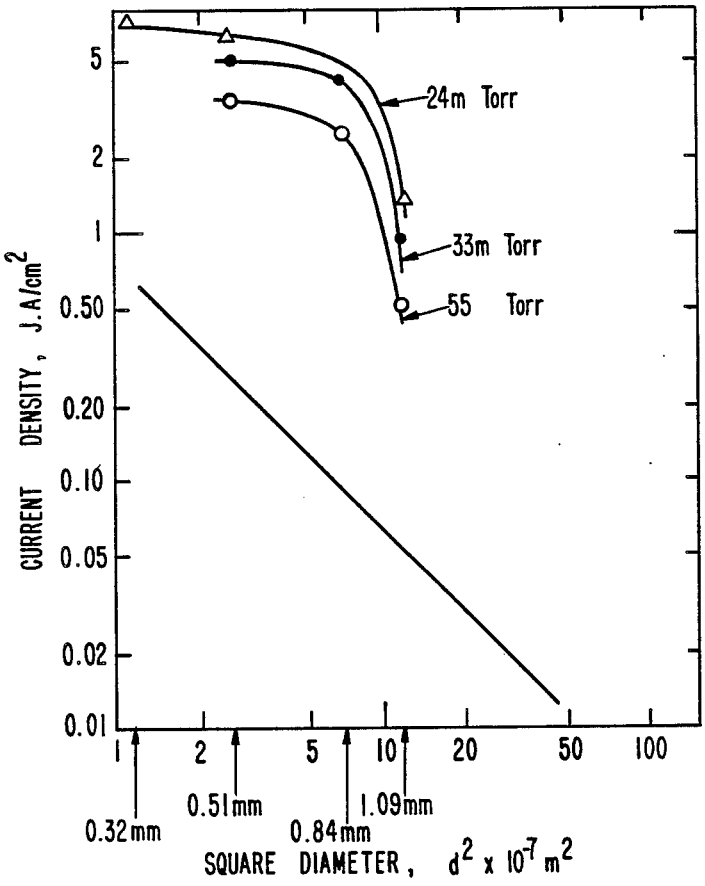
FIG. 8 is a graph plotting experimentally determined scaling of the maximum interruptible switch current density as a function of the squared control grid aperture diameter and gas pressure.

Since the ion current density is low near the CG and anode, high-current interruption can be maintained in the switch with finite-sized control grid apertures. This capability is illustrated in FIG. 8 which shows the results of experiments performed to determine the scaling of maximum-interruptible switch current density with control-grid aperture size. The data points indicate that switch current densities of up to 7 A/cm$^2$ can be interrupted with a grid having 0.32-mm-diameter apertures. The solid line below the data points represents the ion current density at the grid for which the ion sheath size equals the grid-aperture radius as predicted by Child Langmuir theory. As discussed above, this is the ion-current-density threshold at which current interruption begins to become possible.

The observation that the local ion current is an order of magnitude lower than the switch current indicates that most of the switch current is carried by electrons at the position of the control grid. This is not surprising since the CG is located near that anode. In cold-cathode discharges, electrons are collected at the anode, while ions are collected at the cathode. Finally, FIG. 8 also shows that the maximum interruptible current density increases as the gas pressure is reduced. This scaling is also anticipated since lower gas pressure leads to lower plasma density and larger ion sheaths.

Once plasma cut-off at the control grid is achieved, the switch current is interrupted on a time scale determined by the ion transit time across the CG-to-A gap. If the gap size is larger than an ion-sheath thickness, then ions are lost at the ambipolar rate which leads to an opening time given by Equation 2:

$$\tau_{open} \simeq l(T_e/M_i)^{-\frac{1}{2}} \quad (2)$$

where l is the gap size, $T_e$ is the electron temperature, and $M_i$ is the ion mass. If the ion density is very low or the applied negative voltage to the control grid is sufficiently high such that the ion sheath becomes larger than the gap size, then ions can even be accelerated out of the gap at super-ambipolar speeds. Observations of current interruption in both regimes are discussed in the following section.

III. SWITCH INTERRUPTION EXPERIMENTS

Switch interruption experiments have been performed using a 9.5-cm-diameter test model device, with a 30% transparent source grid, and a control grid having an 80% transparent active region with chemically-etched apertures. Control grids with aperture diameters ranging from 1.09 mm to 0.32 mm were evaluated.

Figure 9:
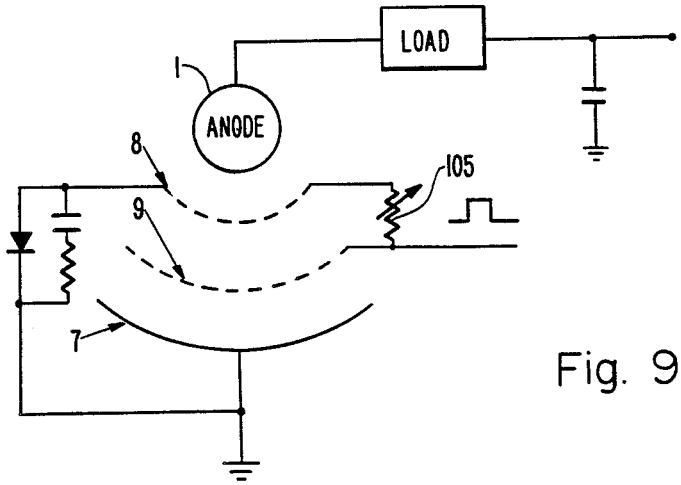
FIG. 9 is a circuit schematic of a circuit employing the switch utilized for current interruption experiments.

The circuit used to demonstrate interruption is shown in FIG. 9. With the cathode held at ground potential, the switch discharge is initiated with a 15-A pulse applied to the source grid. The switch is normally filled with helium gas at a pressure of about 30 mTorr. The control grid is allowed to float near the plasma potential by tying it to the source grid though a 2-k ohm resistor 105. The initial positive bias of the control grid allows the switch to close as soon as source current is provided. At pressure below 30 mTorr, a 100-Ohm pulser is required to momentarily bring the control grid above plasma potential to close the switch. The risetime and magnitude of anode current is then determined by the capacitive power source being switched and the nature of the anode load. For interruption experiments described here, the load was either a high-Q inductor (demonstration of IES circuit interruption) or a pure resistance (demonstration of modulator operation).

As discussed above, interruption is initiated in the switch by returning the control grid to cathode potential or below. When this is done, plasma (i.e., ions) is prevented from entering the CG-to-A gap from the source region and the switch is opened in a time equal to that required to sweep the plasma out of the gap. In practice, the control grid is returned to cathode potential by simply triggering an SCR which is connected across the two electrodes. An RC snubber across the SCR, as shown in FIG. 9, prevents spontaneous SCR triggers due to transients generated during closure. Since the SCR is easily triggered with a TTL-level signal, interruption requires relatively nominal power.

A rather slowly executed, electrostatic-interruption event in an IES circuit is shown in FIG. 10 in order to clearly display the detailed features of the interruption process. The figure repesents the waveforms of the control-grid voltage, anode current, total cathode current, and control-grid-SCR current. At t=0, the control grid is floating at the discharge voltage of a 1-mA keep-alive discharge in the source section, and at t=4 μs, the 15-A source current is turned on, as is seen in the cathode-current waveform. The inductively-limited anode current then rises to 120 A, and at t=30 μs, the control grid is shorted to the cathode. The cathode current falls immediately and the control-grid-SCR current rises abruptly as the control grid now carries most of the switch current. The switch remains in this state for several microseconds of dwell time which is determined by the ion sheath size and the diameter of the control-grid apertures. In this case, the sheath size is on the order of the 0.84-mm-diameter control-grid apertures used in this test and so the dwell time is long (about 6 μs). At the end of the dwell period, anode current interrupts in about 2 82 s, the control-grid current vanishes, and the cathode current returns to the 15-A level of the source discharge.

FIG. 11(*a*) shows the anode and control grid SCR currents on a shorter time scale at lower anode current (about 40 A) where the dwell time is almost negligible. Following the 1-μs period required to turn-on the SCR, the anode current immediately falls and fully interrupts in 2 μs. This time is consistent with the 1-μs plasma-sweep-out time in the 8.2-mm CG-to-A gap computed from Equation 2. Consistent with this equation, the interruption time is reduced by half to 1 μs when the gap spacing is reduced to 4.1 mm in a helium discharge, as shown in FIG. 11(*b*). If the working gas is changed to hydrogen such that the ion mass is reduced by a factor of four, the interruption time is further reduced to 500 ns.

Rather than simply returning the CG to cathode potential to initiate interruption, faster interruption times can be achieved by driving the CG below cathode potential. This is easily accomplished by placing a small capacitor (0.1 μF) in series with the SCR between the CG and cathode. With the capacitor charged to −200 V, the interruption time can be reduced to only 50 ns at low currents (about 30 A), as shown in FIG. 12, which plots the anode current waveform. Presumably, this ultra-fast interruption time is made possible by accelerating ions out of the CG-to-A gap at super-ambipolar rates, as mentioned in the previous section.

Figure 13:
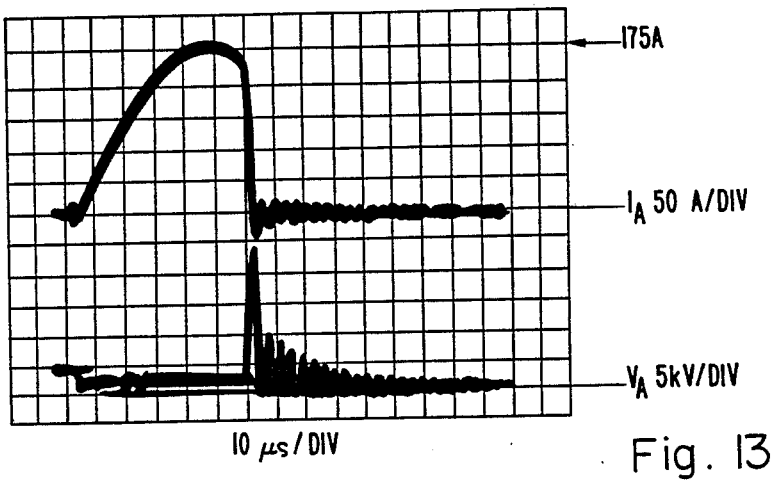
FIG. 13 depicts the anode current and voltage waveforms illustrating high current density interruption of the switch employed in an IES circuit.

At high switch current density (above 5 A/cm$^2$), the plasma density near the CG is higher, the ion sheaths are small compared to the CG-to-A gap spacing, and super-ambipolar interruption cannot be maintained unless very high negative voltage is applied to the CG. High negative bias is not desirable, however, since this requires significant control power and becomes tantamount to commutation. Therefore, interruption times in the 500-ns to 2-μs range are more typical at high current density. FIG. 13 shows interruption of anode current in an IES circuit at 5 A/cm$^2$ (175-A total switch current), with the anticipated 2-μs interruption time in an 8.2-mm gap. The lower waveform in the figure shows the anode voltage $V_A$ kick up to 15 kV (due to the induced voltage across the inductor) without re-initiating conduction. The ringing signal, which follows interruption, is caused by coupling of stray capacitance with the circuit inductor.

As discussed in the previous section, the maximum interruption current in the present switch is determined by both the control-grid aperture size and the gas pressure. This scaling was determined experimentally using the 9.5-cm-diameter test device discussed above, and the results are plotted in FIG. 14. Data were taken with four different control grids having aperture diameters of 1.09, 0.84, 0.51, and 0.32 mm, respectively. The helium gas pressure was also varied from 0 to 60 mTorr and the current was plotted versus pressure for each control grid used. The results show that maximum interruptible current falls exponentially as the gas pressure rises. This is presumably due to increased ionization, a higher ion density near the grid, and a smaller ion-sheath thickness as the pressure is increased. The interruptible current also rises as the grid-aperture diameter decreases (as discussed in connection with FIG. 8). Finally, FIG. 14 also shows why thyratron devices are incapable of maintaining electrostatic control over switch current once the tyratron discharge is initiated. Thyratrons typically employ highly transparent, large-aperture grids in a high pressure (greater than 100 mTorr) environment. Extrapolation of the curves in FIG. 14 would indicate that such a device would be able to interrupt only a few amperes of switch current.

IV. MODULATOR EXPERIMENTS

Figure 15:
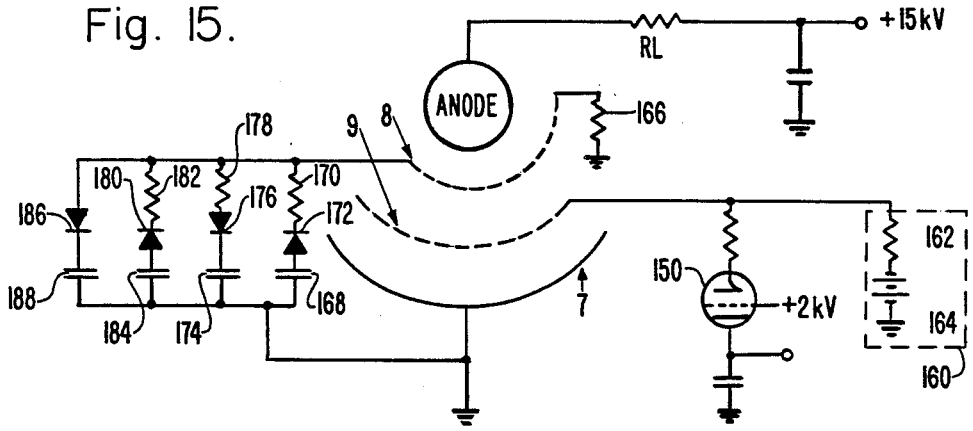
FIG. 15 is a schematic of a circuit employing the switch as a modulator.

Switch operation in the modulator mode (ON/OFF switch) has been demonstrated by replacing the inductive load with a 50- to 500-ohm resistor. The circuit used for these modulator experiments is shown in FIG. 15. The source-grid current of about 40 A is supplied by discharging a 10-μF capacitor with a small thyratron 150. A few mA of dc keep-alive current is also supplied to the source grid from a small power supply 160, comprising 300 V voltage source 164 in series with 100K ohm resistor 162 in order to allow low-jitter (about 10 ns), ON-command triggering of the switch. The control grid is tied weakly to the cathode potential through 1-M Ohm resistor 166.

The initial CG bias delays switch conduction from when the 40-A SG current is applied until the CG is tirggered with a positive voltage pulse of 600 V. This CG trigger pulse is generated by discharging 0.1-μF capacitor 168 through 10-Ohm resistior 170 with SCR 172. Upon application of this trigger pulse, the switch closes in the manner described in connection with FIGS. 3 and 4. In order to interrupt the current and re-open the switch, second SCR 176 discharges 0.2-μF 174 capacitor charged to −360 V through 1.6-Ohm resistor 178. This second pulse brings the CG bias down below cathode potential and quickly opens the switch.

If it is desired to produce a second modulator pulse with short dwell time before the first two SCR pulsers recover, additional SCR pulsers with lower output impedance may be used, as shown in FIG. 15. Thus, third SCR 180 discharges 0.2 μF capacitor 184 through 1-Ohm resistor 182, and fourth SCR 186 discharges 10 μF capacitor 188. The capacitors 168, 174, 184 and 188 are charged to their respective voltages by separate voltage sources, e.g., batteries, not shown in FIG. 15.

Figure 16:
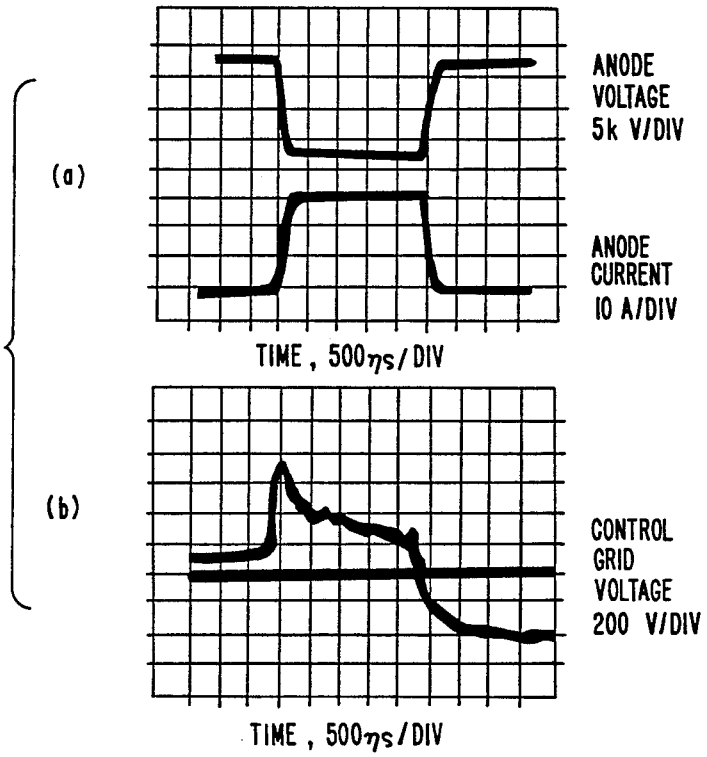
FIGS. 16(*a*) and (*b*) depict anode voltage, anode current, and control grid voltage waveforms of the switch employed to achieve fast, single-pulse modulator operation.
Figure 17:
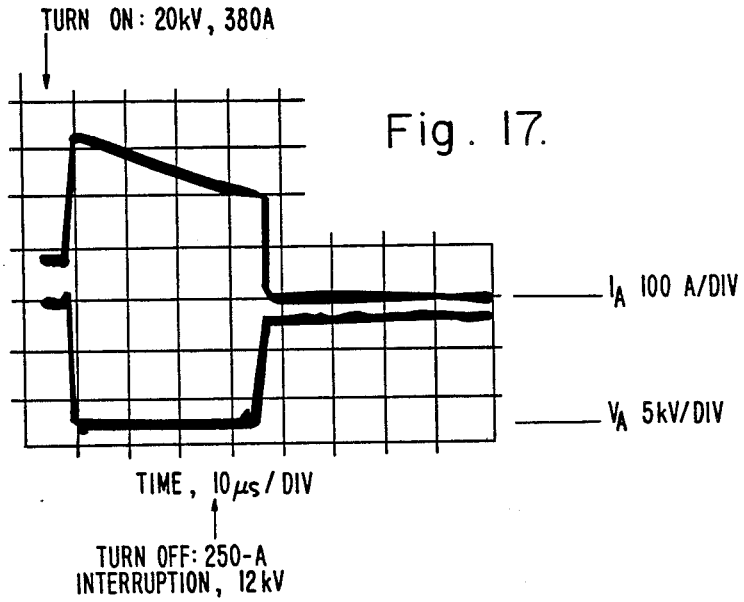
FIG. 17 depicts the anode current voltage waveforms of the switch employed for modulator service.

Fast, single pulse modulator operation is illustrated in FIG. 16(*a*) where the switch was used to produce a 15-kV, 30-A anode current pulse with a 2-μs pulse width and 200-ns rise and fall times. FIG. 15(*b*) depicts the control-grid voltage waveform used to produce this fast, square-pulse switching. Only 600 V of bias are necessary to switch 15 kV on the anode. In addition, power is dissipated in the grid circuit only during the rise and fall of the anode pulse. During conduction, the control-grid floats and draws no current. This contrasts sharply with grid operation in hard tubes where the grid draws current and dissipates power during the entire pulse. From the standpoint of energy efficency, the control-grid requires only 5 mJ to switch 1 J of energy in the anode circuit. For longer pulse lengths, the energy amplification ratio (200 in this case) increases in proportion to the pulse length.

Figure 14:
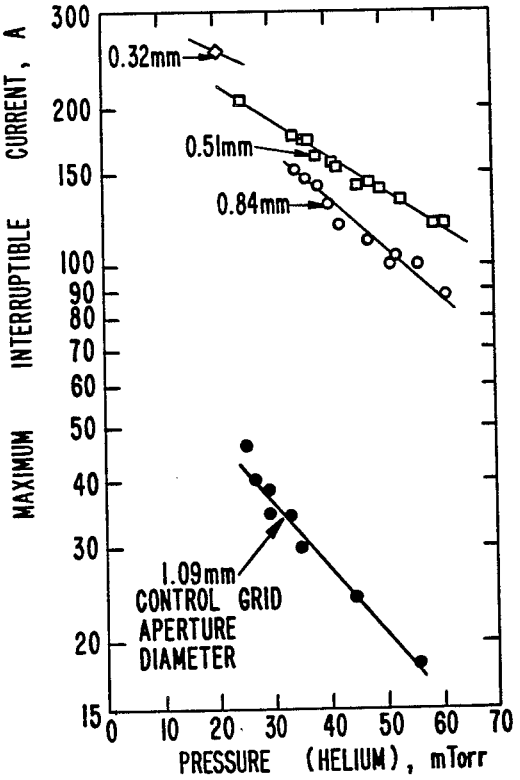
FIG. 14 is a graph illustrating the maximum interruptible current of the switch as a function of gas pressure and control-grid aperture size.

Switching power limits of the 9.5-cm switch device were tested for modulator service and found to be 7.5 MW in closing and about 3 MW in opening. FIG. 16 depicts the anode current and voltage waveforms for switching at this high power level. The switch closes from 20 kV to conduct 380 A and then opens on-command 45 μs later to interrupt 250 A (current droop is due to RC decay of the capacitor bank) at 12 kV. For this switch, the open circuit voltage is limited to 20 kV by vacuum breakdown in the 4.1-mm CG-to-A gap, and the conduction current is limited to 380 A by glow-to-arc transition at the cathode. Opening at 250 A was previously determined to be limited by the 0.3-mm control-grid aperture diameter and the 22-mTorr gas pressure (FIG. 14). The modulator power capability of this small test device already exceeds the capability of the most advanced hard-vacuum switch tubes.

Figure 18:
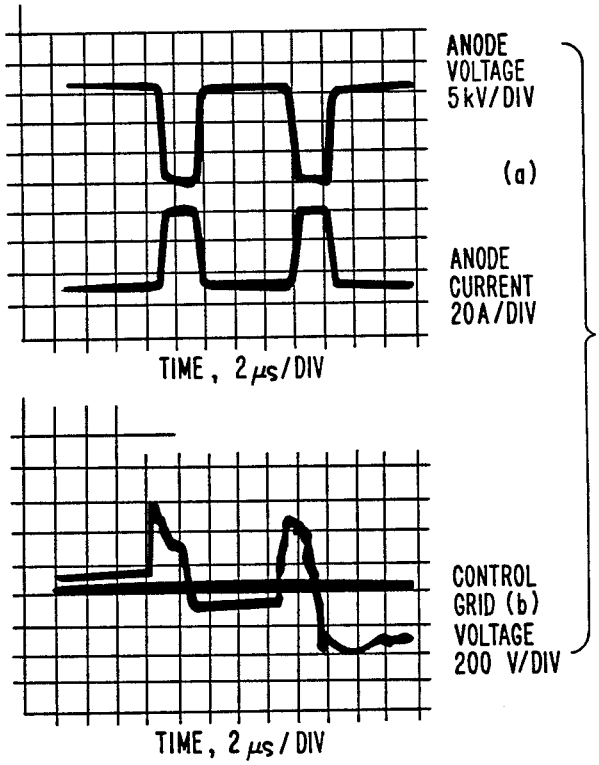
FIGS. 18(*a*) and (*b*) depict the anode voltage and current waveforms and control grid voltage waveform of the switch employed for dual-pulse modulator operation.

Dual-pulse modulator operation has also been demonstrated in the 9.5-cm test device. This was accomplished using four CG-SCR pulsers (FIG. 15) fired in sequence with appropriately delayed triggers. The four pulsers alternately bring the control grid potential above and below the 200-V plasma potential to close and open the switch. An example of dual-pulse operation is shown in FIG. 18(*a*) where the anode voltage and current waveforms are depicted. The corresponding control grid voltage bias waveform is shown in FIG. 18(*b*). Each 2-μs-wide pulse delivers 45 A at 15 kV to the 340-Ohm load. From FIG. 18(*b*), it can be seen that less than 500-V of grid bias is necessary to modulate 675 kW of power.

Figure 19:
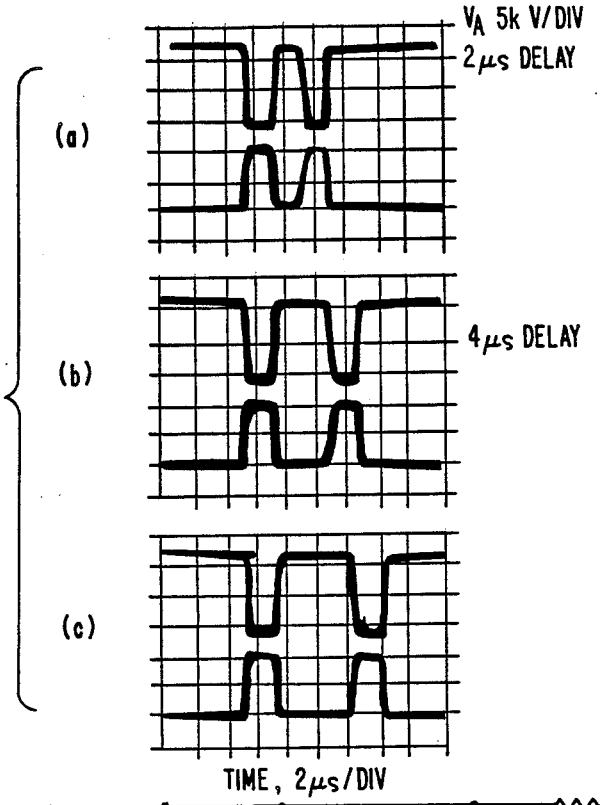
FIGS. 19(*a*)–(*c*) depict the anode voltage waveform of the switch employed in multiple-pulse operation.

By varying the delay of the control-grid pulses, the dwell time between modulator pulses can be varied at will. This demonstration of variable dwell time is shown in FIGS. 19(*a*)–(*c*) where anode current and voltage waveforms are depicted for dwell times of 2, 4, and 6 μs between each 2-μs wide pulse. The fast switching and short dwell times achieved in FIG. 19 are made possible by the fast recovery capability of the switch. Since sequentially triggered SCR closing switches were used to manipulate the control-grid bias (FIG. 15), the slew rate of the control-grid voltage was limited by coupling between adjacent SCR-pulsers. This is particularly true for the 2-μs dwell time waveforms in FIG. 19(*a*) where the lower CG-bias slew rate slowed the fall of the first pulse and rise of the second pulse.

Figure 20:
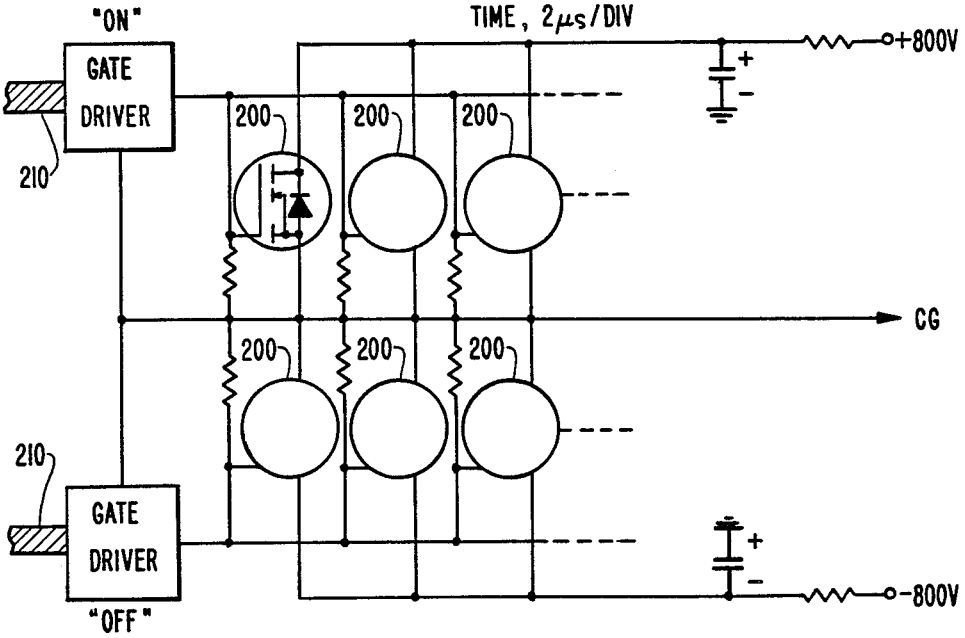
FIG. 20 is a schematic of a control-grid pulser circuit for the switch using MOSFET transistor modulators.

The CG-bias slew-rate limitation can be eliminated by replacing the SCR-pulsers with a pair of MOSFET transistor modulators. The circuit is shown in FIG. 20 where two parallel arrays of MOSFETs 200 (for example, Siemens BUZ54 devices) are arranged in a push-pull configuration in order to modulate the CG voltage up to ±800 V. The modulators are gated by fiber optic lines 210 such that grid control may be exercised from laboratory ground with TTL-signals.

Figure 21:
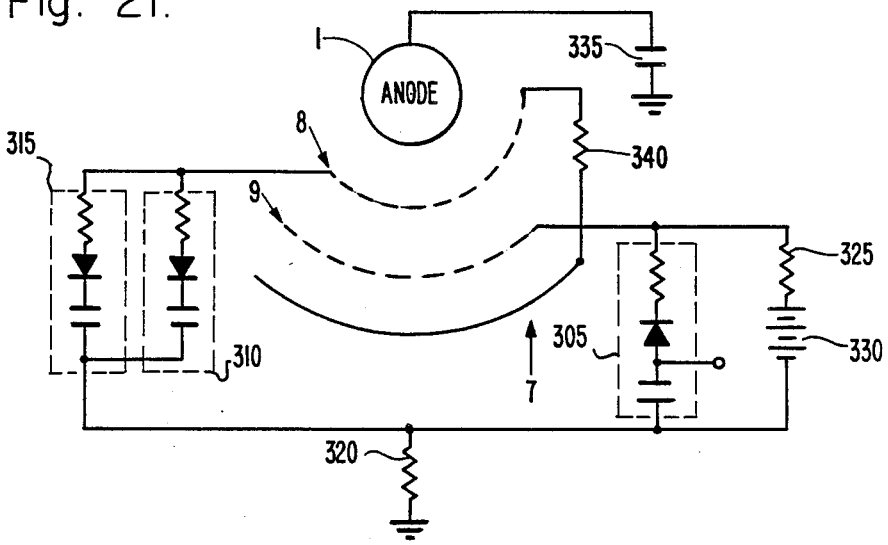
FIG. 21 is a schematic diagram of a simple electric circuit for operation of the modulator switch.

A schematic of a simple electrical circuit for operation of the present modulator circuit is illustrated in FIG. 21. Capacitor 335 represents the power supply coupled to switch anode 1. Resistor 320 represents the load coupled to the cathode 7.

The source grid is coupled to 300 V power source 330 by 100K ohm resistor 325. Source pulser 305 is also coupled to the source grid, and comprises a resistor an SCR and a capacitor charged by a 1-kV power supply.

Control grid 8 is coupled to cathode 7 by 1 M-ohm resistor 340. "Off" pulser 315 and "On" pulser 310 are also coupled to the control grid. "On" pulser 310 comprises a resistor, SCR and capacitor charged to a positive potential (relative to the plasma potential) by an external power supply (not shown). "Off" pulser 315 comprises a resistor, SCR and capacitor charged to a negative potential (relative to the plasma potential) by an external power supply (not shown).

The switch operation commences with the closing of the source pulser SCR to ionize the gas in the cathode-source grid gap. (The switch will not commence conduction with both control grid SCRs gated off.) Switch operation is controlled by the state of "On" and "Off" pulser SCRs, as described above with respect to FIG. 15.

Figure 22:
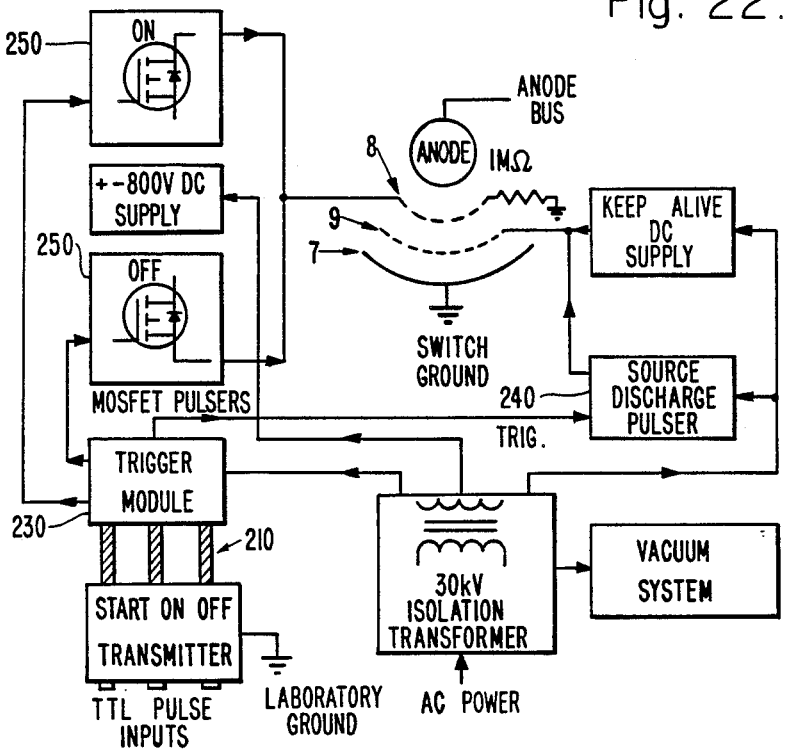
FIG. 22 is a schematic of the general electrical system for the modulator switch of the present invention.

A block diagram of the preferred embodiment of a generalized switch electrical system is shown in FIG. 22. Power for each system element is provided by an isolation transformer which enables each element to be tied to the switch-cathode ground. As discussed above, the switch is controlled with TTL-level pulses from laboratory-ground potential through, for example, Hewlett-Packard HFBR-3500 fiber-optic links 210. The fiber-optic lines isolate the input pulses and drive a trigger module 230 which controls the source-discharge pulser 240 and the control grid MOSFET pulsers 250. Three pulse inputs are required, a START pulse which turns-on the discharge in the C-to-SG gap, an ON pulse which drives the control grid positive and closes the switch, and an OFF pulse which drives the control grid negative and opens the switch. This arrangement allows the operator to exercise on-command control with programmable pulse width, dwell time, and pulse repetition frequency (PRF).

There has been described above a novel high-pulse-power device adapted to modulate (on-command closing and opening) high voltage and high current densities in a plasma discharge by controlling the potential of a grid at relatively low voltage with solid-state devices. The disclosed crossed-field switch is capable of high speed (50-ns to 2 μs) current interruption at high current density (up to 7 A/cm$^2$) under low-voltage electrostatic grid control with convenient low-power solid-state switches. The switch is capable of modulating high-pulse-power devices at higher speed, higher efficiency and higher current than is believed presently possible with conventional plasma switches (thyratrons, ignitrons, spark gaps) or hard tubes. The switch operates in a manner analogous to a thyratron in closing, since it rapidly closes under electrostatic grid control without commutation or magnetic field switching. However, the present switch does not have the long recovery time characteristic of thyratrons and also does not have the low cathode current restriction which is characteristic of hard tubes. In addition, the switch starts instantly, in contrast to thyratrons and hard tubes, requires low standby power, operates at high pulse repetition frequency, and is capable of rugged operation.

Applications for this new switch include advanced power supplies of the hard tube modulator, capacitive discharge modulator and inductive discharge modulator types for gas discharge lasers, flashlamps, particle accelerators, neutral beams, gyrotrons, high power radar transmitters and inductive energy storage systems.

FIGS. 23 and 24 illustrate two circuits in which the switch is advantageously employed. FIG. 23 illustrates a circuit wherein the switch load consists of a gas discharge laser. A current source 405 charges inductor 410, which is coupled in series with the parallel connection of switch 415 and laser 420. The switch comprises a plasma discharge switch of the type described hereinabove. With the switch closed, current flows through the switch, charging inductor 410. When the switch is opened, the current flow is interrupted, inducing a voltage pulse in the inductor. This voltage discharges the gas in the gas laser. The current is diverted from the switch into the laser, causing lasing action.

As described above, the switch is able to interrupt high current and voltage very rapidly. Because the switch has a very short recovery time, a second pulse can be applied very quickly after the first pulse, thereby allowing very high pulse repetition capability. No other switch known to applicants can accomplish this at the high current and high voltages at which the present switch is operable. Moreover, some laser devices, for example, excimer lasers, require very fast current switching and very high voltages to achieve lasing operation. The present switch provides the required switching capability.

Because the switch operates in FIG. 23 with a low forward voltage drop, it performs with high efficiency. Moreover, other types of loads may be employed in the circuit of FIG. 23, e.g., particle accelerators and laser flashlamps.

FIG. 24 is a simplified schematic of a circuit wherein the switch load consists of a resistive load, e.g., a microwave generator (such as a TWT or gyrotron) or a particle accelerator. Voltage source 450 is connected in series with switch 455 and load 460. As the switch is operated, the voltage is selectively applied to load 460.

The type of switch normally used in circuits as shown in FIG. 24 is the hard tube, which has current limitations due to its thermionic cathode. The present switch can supply much higher current, with low forward voltage drop and no cathode heater power. Therefore, the physical size and weight of the switch and its ancillary circuitry are significantly reduced, and the switch is more efficient electrically. Use of the present switch makes possible high power circuits as illustrated in FIG. 24, as well as mobile, airborne and space applications not serviceable by hard tubes.

Although the present invention has been shown and described with reference to a particular embodiment, nevertheless various changes and modifications obvious to a person skilled in the art to which the invention pertains are deemed to lie within the spirit, scope and contemplation of the invention.

What is claimed is:

1. In a cold-cathode, plasma discharge switch employing a cathode, control grid and an anode, the improvement comprising:

means for providing a non-uniform plasma density distribution between said anode and said cathode, so that said plasma density is relatively high near the cathode and relatively low near the control grid; and means for closing and opening said switch, said means comprising means for applying a positive potential relative to the potential of said plasma to said control grid to initiate conduction, and means for applying a negative potential relative to said plasma potential to said control grid to open the switch.

2. The plasma discharge switch of claim 1 wherein said means for providing a non-uniform plasma density distribution and said means for opening and closing said switch are cooperatively adapted so that, upon application of said negative potential to said control grid, an ion sheath is created around said control grid which achieves plasma cutoff to the anode region.

3. The plasma discharge device of claim 2 wherein the size of said ion sheath is larger than the radius of apertures formed in said control grid.

4. The plasma discharge switch of claim 3 wherein said apertures have diameter sizes in the range of 0.1 to 1 mm.

5. The plasma discharge switch of claim 1 wherein said means for providing a non-uniform plasma density distribution comprises means for maintaining gas under a relatively low pressure between said cathode and said anode.

6. The plasma discharge switch of claim 5 wherein said gas is maintained at a pressure in the range of 1 milliTorr to 50 milliTorr.

7. The plasma discharge switch of claim 1 wherein said means for providing a non-uniform plasma density distribution between said anode and said cathode comprises a crossed-magnetic-field ionization source.

8. The plasma discharge switch of claim 1 wherein said means for providing a non-uniform plasma density distribution comprises a hollow-cathode ionization source.

9. The plasma discharge switch of claim 7 wherein said means for providing a non-uniform plasma density distribution comprises a wire-ion ionization source.

10. The plasma discharge switch of claim 1 wherein said means for providing a non-uniform plasma density distribution comprises a diffuse-arc ionization source.

11. A cold-cathode plasma discharge switch, comprising:

cathode, control and anode electrodes, disclosed in spaced relation;

means for providing a non-uniform plasma density distribution between said anode and said cathode, so that said plasma density is relatively high near the cathode electrode and relatively low near the control electrode;

means for opening and closing said switch, said means adapted to control the potential of said control electrode.

12. The plasma discharge switch of claim 11 wherein said means for opening and closing said switch comprises means for applying a positive potential relative to the potential of said plasma to said control electrode to initiate conduction, and means for applying a negative potential relative to said plasma potential to said control electrode to interrupt switch conduction and thereby open the switch.

13. The plasma discharge switch of claim 12 wherein said means for providing a non-uniform plasma density distribution and said means for opening and closing said switch are cooperatively adapted such that application of said negative potential to said control electrode creates an ion sheath around said control electrode which achieves plasma cutoff to said anode.

14. The plasma discharge switch of claim 13 wherein said control electrode comprises a control grid having relatively small apertures formed therein, and wherein the size of said ion sheath is larger than the radius of apertures formed in said control grid.

15. The plasma discharge switch of claim 15 wherein said means for providing a non-uniform plasma density distribution comprises means for maintaining gas under a relatively low pressure between said anode and said cathode.

16. A cold cathode, crossed-field modulator switch, comprising:

cathode electrode, source grid electrode, control grid electrode having relatively small apertures formed therein, and anode electrode disposed in spaced relation so as to form a cathode-electrode-to-source-grid gap, a source-grid-to-control-grid gap and a control-grid-to-anode electrode gap;

means for maintaining gas under relatively low pressure in said inter-electrode gaps;

means for producing a localized magnetic field which penetrates the cathode-to-source-grid gap but which magnetic field has no functionally significant penetration into the remaining inter-electrode gaps;

means for applying a voltage to said source grid to create a potential difference between said cathode and source grid whereby an electric field is produced which extends at least across said cathode-to-source-grid gap, said magnetic field interacting with said electrical field in the gaseous environment in said cathode-to-source-grid gap to produce a plasma which is a source of electron and ion charge carriers; and modulator circuit means coupled to said control grid, said means adapted to selectively apply a positive potential to said control grid relative to the potential of said plasma to close said switch, and to apply a negative potential to said control grid relative to the plasma potential to interrupt current flow and thereby open the switch.

17. The modulator switch of claim 16 wherein said apertures of said control grid are sized in the range of 0.1 to 1 mm.

18. The modulator switch of claim 16 wherein said gas pressure is in the range of 1 to 50 mTorr.

19. The modulator switch of claim 16 wherein said modulator circuit means comprises a first solid state switch device coupling said control grid to a first voltage source for application of said positive potential to said control grid.

20. The modulator switch of claim 19 wherein said modulator switch circuit comprises a second solid state switch device coupling said control grid to a second voltage source for application of said negative potential to said control grid.

21. The modulator switch of claim 20 wherein said first and second solid state switch devices are controlled by first and second control signals, wherein said modulator switch may be modulated ON and OFF by said control signals.

22. A cold cathode, crossed-field discharge switch, comprising:

anode, cathode, source grid, and control grid electrodes;

electrically insulating means supporting said electrodes in spaced relation, with said source grid adjacent said cathode electrode and said control grid adjacent said anode electrode, so as to provide a cathode-electrode-to-source grid gap, a source-grid-to-control-grid gap, and a control grid-to-anode-electrode gap;

means for maintaining gas under a predetermined pressure in said gaps so that said gas can be ionized for electrical conduction;

means for producing a localized magnetic field which penetrates the cathode-electrode-to-source grid gap;

means for applying a voltage to said source grid to produce an electrostatic field to cause charge carrier generation, said magnetic field interacting with said electrostatic field in the gaseous environment in said inter-electrode gap between said source grid and said cathode electrode to produce a plasma which is a source of electron and ion charge carriers; and means for applying voltage to said control grid, said means being adapted to apply a voltage level at least equal to the plasma potential to close said switch device, said means being further adapted to apply negative potential relative to the plasma potential to interrupt conduction of such device.

23. The switch of claim 22, wherein said control grid is provided with small apertures formed therein.

24. The switch of claim 23, wherein said apertures are in the size range of 0.1 to 1 mm.

25. The switch of claim 22, wherein said predetermined gas pressure is relatively low.

26. The switch of claim 25, wherein said predetermined gas pressure is in the range of 1 milliTorr to 50 milliTorr.

27. The switch of claim 22, wherein said control grid is disposed in relative proximity to said anode.

28. The switch of claim 27, wherein said control grid is disposed as close to said anode as allowed by vacuum breakdown considerations.

29. The switch of claim 22, wherein said switch is adapted to produce a non-uniform plasma density distribution between said cathode and said anode.

30. The switch of claim 29, wherein said plasma density is relatively high in the cathode-to-source-grid gap and relatively low in the control-grid-to-anode gap.

31. The switch of claim 30, wherein said predetermined gas pressure is in the range of 1 milliTorr to 50 milliTorr.

32. The switch of claim 31, wherein said means for producing a localized magnetic field comprises permanent magnet means.

33. The switch of claim 22, wherein said means for applying a voltage to said control grid comprises solid-state switching means adapted to selectively close so as to apply said negative potential to said control grid.

34. The switch of claim 22, wherein said means for applying a voltage to said control grid is adapted to couple said control grid to the potential of the cathode electrode.

35. The switch of claim 22, wherein said means for applying a voltage to said control grid is adapted to apply a potential to said control grid which is negative relative to the potential of said cathode.

36. The switch of claim 22 wherein said means for applying a voltage to said source grid comprises solid state switching means adapted to selectively close so as to apply said voltage to said source grid.

37. An inductive energy storage circuit comprising:

a current source;

an inductive energy storage means coupled to said current source;

a load; and switch means adapted to selectively couple said load to said inductive energy storage means by selectively opening and closing, said switch means comprising a cold-cathode plasma discharge switch comprising:

(i) cathode, control grid and anode electrodes, (ii) means for providing a non-uniform plasma density distribution between said anode and said cathode electrodes, so that said plasma density is relatively high near the cathode and relatively low near the anode; and (iii) means for closing and opening said switch, said means comprising means for applying a positive potential relative to the potential of said plasma to said control grid to close said switch, and means for applying a negative potential relative to said plasma potential to said control electrode to open said switch.

38. The circuit of claim 37 wherein said load comprises a gas discharge laser.

39. The circuit of claim 37 wherein said load comprises a particle accelerator.

40. The circuit of claim 37 wherein said load comprises a laser flashlamp.

41. A resistive load modulator circuit comprising:

a voltage source;

a resistive load; and modulator switch means adapted to selectively couple said load to said voltage source by selectively opening and closing, said switch means comprising a cold-cathode, plasma discharge switch comprising:

(i) cathode, control grid and anode electrodes;

(ii) means for providing a non-uniform plasma density distribution between said anode and said cathode electrodes, so that said plasma density is relatively high near the cathode and relatively low near the anode; and (iii) means for closing and opening said switch, said means comprising means for applying a positive potential relative to the potential of said plasma to said control grid to close said switch, and means for applying a negative potential relative to said plasma potential to said control grid to open said switch.

42. The circuit of claim 41 wherein said load comprises a gyratron microwave generator.

43. The circuit of claim 41 wherein said load comprises a high power radar transmitter.

44. The circuit of claim 41 wherein said load comprises a neutral beam source.

45. The circuit of claim 41 wherein said load comprises a free electron laser.

* * * * *